United States Patent [19]

Hillier

[11] 4,184,568

[45] Jan. 22, 1980

[54] SAFETY DEVICE FOR LADDER CLIMBING

[76] Inventor: John Hillier, R.R. #1, Camlachie, Ontario, Canada, N0N 1B0

[21] Appl. No.: 963,888

[22] Filed: Nov. 27, 1978

[30] Foreign Application Priority Data

Jan. 20, 1978 [CA] Canada ..... 295355

[51] Int. Cl.[2] ..... A62B 1/16; E06C 7/18

[52] U.S. Cl. ..... 182/8

[58] Field of Search ..... 182/8

[56] References Cited

U.S. PATENT DOCUMENTS

| | | | |
|---|---|---|---|
| 543,464 | 7/1895 | Brucksch | 182/8 |
| 2,886,227 | 5/1959 | Rose | 182/8 |
| 3,417,840 | 12/1968 | Farnsworth | 182/8 |
| 4,130,177 | 12/1978 | Pandolph | 182/8 |

FOREIGN PATENT DOCUMENTS

| | | | |
|---|---|---|---|
| 215653 | 9/1967 | Sweden | 182/8 |
| 1501945 | 2/1978 | United Kingdom | 182/8 |

*Primary Examiner*—Reinaldo P. Machado

*Attorney, Agent, or Firm*—Cushman, Darby & Cushman

[57] ABSTRACT

A ladder or the like climbing safety device of the type of a pair of hooks is provided, at each of the hooks, with a "U"-shaped clip adapted to engage the back and the palm of the respective hand of the user. The device is thus easily detachable from the respective hands either during the climbing or when the user is off the ladder, manhole steps or the like. The device is of a simple structure that not only reduces it's manufacturing costs but also combines the ease of engagement with and disengagement from the respective hands of the user, thus considerably reducing the rather cumbersome handling of many of know prior art devices of this type.

24 Claims, 4 Drawing Figures

SAFETY DEVICE FOR LADDER CLIMBING

The present invention relates to a safety device for use in climbing ladders, manhole steps or the like, the device being of the type having a pair of hook-shaped members adapted to engage the rungs of a ladder or manhole steps as the person climbs same. The hooks are normally secured to a flexible rope or the like which is attached to a person's waist, either directly or by a belt.

In general, the use of the device is intended to prevent accidental fall of the person off a ladder. The hooks are normally detachably secured to a person's hand such that the person carries on each of the hands one of the hook members in such a fashion that as the rungs of the ladder are frequented, the respective hook is always placed above and over the respective rung. Accordingly, if an accidental slippage occurrs the hook engages the respective rung and, being secured by the rope to the person's waist, prevents the person from falling down.

One of the prerequisites of the devices of the above type is that they be detactably secured to the person's hand. The way of securing the device to a person's hand is very important; when the device is secured to the hand, it should minimize inconvenience of the person and yet be relatively steady such as to avoid falling off of the device during the climbing. On the other hand, if the user desires to remove the device from his hands, such removal must be done in most convenient and thus expeditious way. It is well established that the covenience of use and manipulation of any safety device is one of the main factors that determine whether or not the device is actually being used by workers.

The devices of the aforesaid type have been long known in the art. Reference may be had in this context to U.S. Pat. No. 543,464, issued July 30, 1895 to Brucksch, to U.S. Pat. No. 3,417,840 issued Dec. 24, 1968 to Farnsworth, U.S. Pat. No. 2,886,227 issued May 12, 1959 to Rose and to Swedish Pat. No. 215,653 issued Sept. 26, 1967 to Halldin.

All of the known devices of this type have one common feature with the respect to the securing of the respective hooks to the hand: the means securing the hook to the hand completely surround in transverse direction either the whole hand or at least the finger to which the hook is to be attached. Thus, Brucksch shows a device wherein the hook is fastened to the thumb of the person, for instance by providing a generally channel-shaped arrangement at the stem of the hook. The thumb is inserted into such channel in order to hold the respective hooks as desired. Brucksch assumes that the thumb is inactive in frequenting ladders. However, it is well known that many persons prefer grasping the respective rungs by using the thumb. Such persons would most likely be inconvenienced by the Brucksch device, not to mention the fact that the securing and maintaining in a secured position of the hook by way of a channel is relatively inconvenient. Farnsworth proposes the use of a hook which is secured to a glove. Such device thus also completely surrounds the hand or a part thereof. If used in summer, the gloves may pose undue inconvenience. In winter, the user may prefer to use much thicker gloves over which it would be virtually impossible to wear the glove as proposed in Farnsworth. Swedish Pat. No. 215,653 shows another arrangement wherein the respective hook member is secured to the hand by a strap enveloping the wrist area of the user's hand. The device is relatively bulky and certainly must feel strange while frequenting the ladder. Releasing of the hooks from respective hands is relatively difficult as the person would have to release the strap first and then move the hand out of its engagement with the hooks. Rose, it al is generally similar to the Swedish Pat. No. 215,653 in that it comprises a strap that is placed over an area of the back of the hand.

It is an object of the present invention to provide a device of the aforesaid type which would provide further improvement in the art by improving the ease and convenience of attachment or detachment of the hook member to the respective hands, thus increasing the overall convenience of use. At the same time, the present invention is directed towards making the device as simple as possible in order to facilitate manufacture and reduce the cost of the device.

In one aspect of the present invention, the invention provides a device for releasably securing to a person's hand hook means of a safety device for climbing ladders or the like, said device being of a generally "U"-shaped configuration formed by a base and two arms protruding from same, said base being secured to a stem portion of said hook means such that the stem portion extends generally perpendicularly to a plane defined by the "U", said two arms being resiliently yieldable in a direction of spreading apart the free ends thereof, the spacing between said two arms being selected such that inside surfaces of said arms are capable to resiliently engage the back and the palm of a person's hand, respectively.

According to another aspect of the present invention, a safety apparatus is provide for climbing a ladder, manhole steps or the like, comprising, in combination (A) flexible rope means adapted to become secured to a person's waist; (B) a pair of hook means secured to the respective ends of the flexible rope means; (C) each of said hook means being provided with a device for releasibly securing to a person's hand said hook means said device being of a generally "U"-shaped configuration formed by a base and two arms protruding from same, said base being secured to a stem portion of said hook means such that the stem portion extends generally perpendicularly to a plane defined by the "U", said two arms being resiliently yieldable in a direction of spreading apart the force ends thereof, the spacing between said two arms being selected such that inside surfaces of said arms are capable to resiliently engage the back palm of a person's hand respectively.

The invention will now be described by way of a preferred embodiment with reference to the accompanying drawings.

IN THE DRAWINGS

Figure 3:
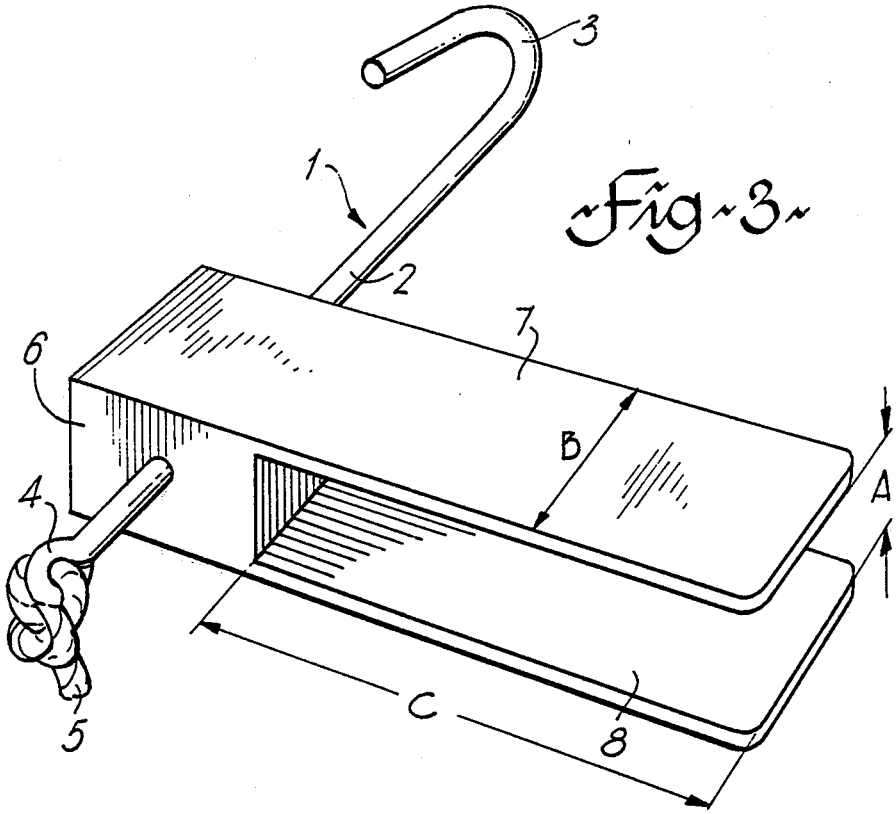
FIG. 3 is a perspective view showing the preferred embodiment of the device for securing the hook to a person's hand.
Figure 1:
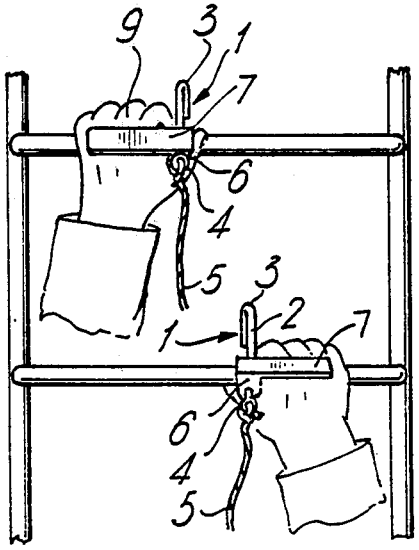
FIG. 1 is a partly broken view of a ladder indicating the overall arrangement of the device of the present invention.
Figure 2:
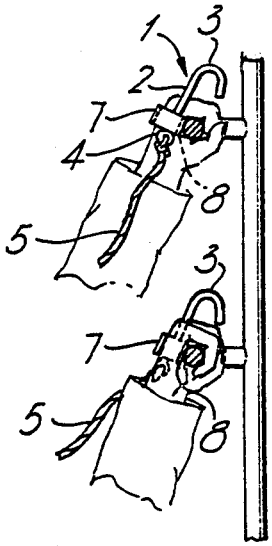
FIG. 2 is a view similar to that of FIG. 1 but taken from one side thereof.

The structural features of the device can best be appreciated from FIG. 3 even though, obviously, this Figure only shows one of the two devices of the kind as is apparent on comparing FIG. 3 with FIGS. 1 and 2.

The device includes a hook member 1 having a generally straight stem portion 2 whose one end forms a hook 3, the opposite end of the stem having an eyelet 4 to which is secured one end of a rope 5. In the particular embodiment, even though not explicitly shown to a greater or lesser degree. It was found that the optimum width B of the arms is also approximately 25 millimeters, while the preferred length C is about 70 millimeters.

In use, the user of the device simply places the arms 7, 8 over his hand such that the inside surface of arms 7 bears against the person's palm, while the lower arm 8 engages at the back of the hand, as will readily be appreciated from FIG. 1. The device is placed such that the stem 2 is at the thumb side of the respective hand with the hook being bent away from the back of the person's hand.

The stem 2 is preferably fixedly secured to base 6, preferably by way of inserting the stem into a mold when making the U-shaped member. The device is extremely easy to insert over or remove from the person's hand. Yet, it safely slips the respective hook member 1 to the hand while leaving the hand free to frequent the rungs of the ladder or manhole steps virtually free of any obstruction, to increase the convience of use of the device. Those skilled in the art will also appreciate that the manufacturing cost of the device is relatively low compared with what is know from prior art, without any reduction as to the overall quality of the product.

Many modifications of the device as described above are readily conceivable. For instance, the hook 1 need not necessarily be fixedly secured to base 6; instead, one may contemplate at the arrangement wherein the stem 2 would be prevented from axial displacement relative to block 6 but would at the same time be pivotable within its passage through block 6. It is believed that the manufacture of the "U"-shaped member from a plastic material is optimum from the standpoint of production costs, particularly in view of the fact that many plastic materials are well known that can withstand in the drawings, the rope 5 is long enough to allow for tying of same around a person's waist. One end of the rope 5 is secured to the eyelet 4 as shown, it being understood that the opposite end of rope 5 would be secured to the other member that would correspond to the member shown in FIG. 3 but would have the hook 3 turned down as opposed to the upward turn of FIG. 3, as will be readily appreciated on comparing FIG. 3 with FIG. 1 or 2.

Figure 4:
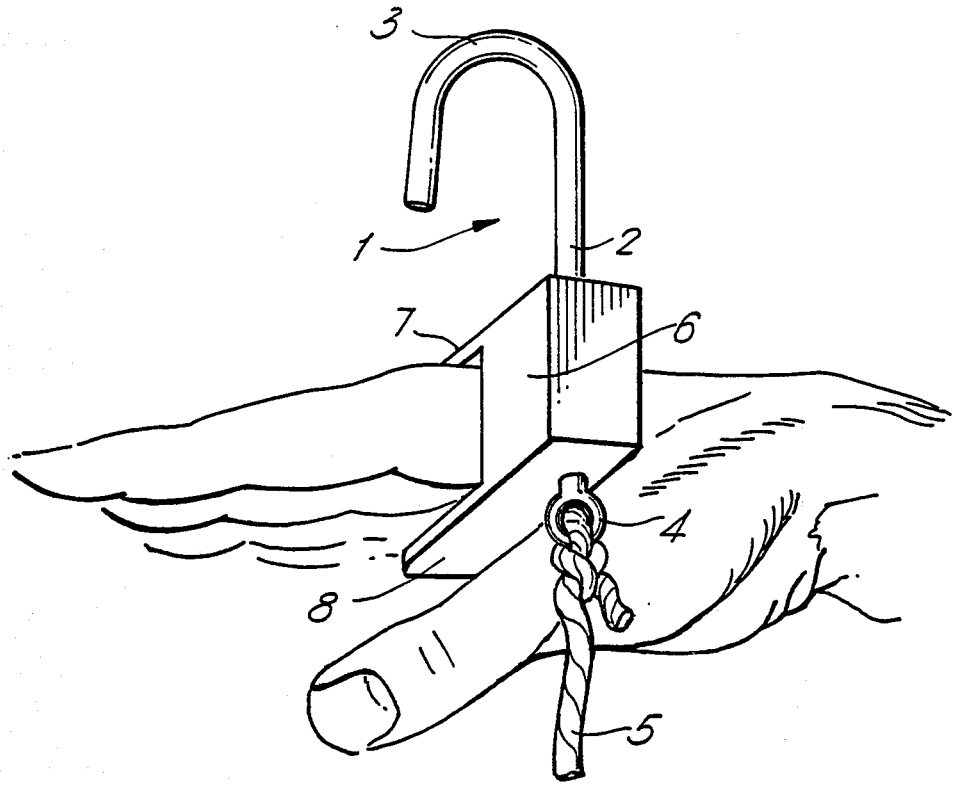
FIG. 4 is a perspective view of the device attached to the hand.

A portion of the stem 2 passes through a base 6 from which protrudes a pair of arms comprised of an upper arm 7 and a lower arm 8. The base 6 and arms 7 and 8 are integral members, preferably made by molding from a thermoplastic material such as nylon (trade name). In the embodiment shown in FIG. 3, the upper arm 7 and the lower arm 8 are generally parallel with each other, the spacing between the two arms generally corresponding to the thickness of base member 6. It will be appreciated that when viewing the entire configuration generally in the direction of stem portion 2, then the base 6 and arms 7, 8 form what may also be referred to as a generally "U"-shaped configuration. There is a great variety of materials suitable for making the base and the arms, the essential feature being that the arms 7 and 8 be somewhat springy such that they can be partially spread apart when the device is inserted over a person's hand to arrive at an arrangement as shown in FIG. 4. In general terms, the spacing between the arms 7 and 8 is such that the arms are capable to resiliently engage the back and the palm of a person's hand 9, respectively. It was found that is the spacing A between arms 7 and 8 is approximately 25 millimeters, then such device is most universal from the standpoint of an average human hand size. It is to be appreciated, of course, that this size and other sizes referred to hereinafter may vary relatively wide temperature differentials without making the material brittle. However, it is equally possible to produce the arms 7 and 8 as non-integral units with respect to the block 6. For instance, the block 6 may be made of wood and the arms 7, 8 from a suitable springy metal sheet. Another readily conceivable modification would make the arms 7, 8 of unequal length, even though it is believed that such modification would not be of advantage. One might also conceive an arrangement wherein the free ends of arms 7 and 8 would normally be in a contact and would be merely spread apart when inserting the person's hand inbetween to clip the hook member 1 to the hand.

These and many other modifications of the preferred embodiment clearly indicate that the scope of the present invention is by no means limited to such preferred emodiment, the scope of the present invention being indicated in the accompanying claims.

The embodiments of the invention in which an exclusive property or privilege is claimed are defined as follows:

1. A device for releasably securing to a person's hand hook means of a safety device for climbing ladders or the like, said device being of a generally "U"-shaped configuration formed by a base and two arms protruding same, said base being secured to a stem portion of said hook means such that the stem portion extends generally perpendicularly to a plane defined by the "U", said two arms being resiliently yieldable in a direction of spreading apart the free ends thereof, the spacing between said two arms being selected such that inside surfaces of said arms are capable to resiliently engage the back and the palm of a person's hand, respectively.

2. A device as claimed in claim 1, wherein the free end of said arms are normally spaced apart to facilitate inserting of a person's hand between said arms.

3. A device as claimed in claim 1, wherein the width of the arms as measured in a direction generally parallel with said stem, is about one-half of the length of a person's palm.

4. A device as claimed in claim 1, wherein the stem is fixedly secured to the base with the hook end of said hook means being generally coincident with a plane perpendicular to said plane defined by said "U".

5. A device as claimed in claim 1, wherein the stem passes through the base and has rope securing means at the end thereof remote from the hook end of said stem.

6. A device as claimed in claim 1, wherein the arms are generally parallel with each other and are spaced apart at approximately 25 millimeters.

7. A device as claimed in claim 1, wherein the width of the arms is approximately 25 millimeters.

8. A device as claimed in claim 1, wherein the arms are generally equal in length as measured between the base and the free ends of the arms.

9. A device as claimed in claim 1, wherein the length of said arms is about three-quarters of the width of a person's hand.

10. A device as claimed in claim 1, wherein the length of the arms is about 70 millimeters.

11. A device as claimed in claim 1, wherein the arms and the base are integral with each other.

12. A device as claimed in claim 1, wherein the arms and the base are integral with each other and are made of thermo-plastic material.

13. A safety apparatus for climbing a ladder, manhole steps or the like, comprising, in combination;

(A) flexible rope means adapted to become secured to a person's waist;

(B) a pair of hook means secured to the respective ends of the flexible rope means;

(C) each of said hook means being provided with a device for releasably securing to a person's hand said hook means said device being of a generally "U"-shaped configuration formed by a base and two arms protruding from same, said base being secured to a stem portion of said hook means such that the stem portion extends generally perpendicularly to a plane defined by the "U", said two arms being resiliently yieldable in a direction of spreading apart the force ends thereof, the spacing between said two arms being selected such that inside surfaces of said arms are capable to resiliently engage the back and the palm of a person's hand, respectively.

14. Apparatus as claimed in claim 13, wherein the free ends of arms of each of said devices are spaced apart to facilitate the inserting of the hand of a person between the respective arms.

15. Apparatus as claimed in claim 13, wherein the width of each of the arms is about one-half of the length of a person's palm.

16. Apparatus as claimed in claim 13, wherein the respective stem is fixedly secured to the respective base with the hook end of said stem being generally coincident with a plane generally perpendicular to the respective plane defined by the respective "U".

17. Apparatus as claimed in claim 13, wherein each of the respective stems passes through the respective base and is secured to said rope means at the end of said stem remote from the hook end thereof.

18. Apparatus as claimed in claim 13, wherein the respective arms of each of the devices are spaced apart at about 25 millimeters.

19. Apparatus as claimed in claim 13, wherein the width of said arms is about 25 millimeters.

20. Apparatus as claimed in claim 13, wherein the arms are equal in length as measured between the respective base and the respective free ends of the respective arms.

21. Apparatus as claimed in claim 13, wherein the length of each of said arms is about three-quarters of the width of a person's hand.

22. Apparatus as claimed in claim 13, wherein the length of arms as measured between the respective base and the free ends of the respective arms is about 70 millimeters.

23. Apparatus as claimed in claim 13, wherein the respective arms and the respective base form an integral member.

24. Apparatus as claimed in claim 23, wherein the respective arms and the respective base are each an integral member made of thermal plastic material.

* * * * *

UNITED STATES PATENT AND TRADEMARK OFFICE

CERTIFICATE OF CORRECTION

PATENT NO. : 4,184,568

DATED : January 22, 1980

INVENTOR(S) : John Hillier

It is certified that error appears in the above—identified patent and that said Letters Patent is hereby corrected as shown below:

Column 5, Claim 13, line 20, change "force" to --free--.

Signed and Sealed this

*Fifteenth* Day of *July 1980*

[SEAL]

*Attest:*

SIDNEY A. DIAMOND

*Attesting Officer*

*Commissioner of Patents and Trademarks*